US010850887B2

(12) United States Patent
Dammers et al.

(10) Patent No.: US 10,850,887 B2
(45) Date of Patent: Dec. 1, 2020

(54) CARTON SLEEVE, CARTON AND METHOD FOR PRODUCING A CARTON

(71) Applicant: SIG Technology AG, Neuhausen am Rheinfall (CH)

(72) Inventors: Matthias Dammers, Alsdorf (DE); Birgit Birninger, Linnich (DE); Christoph Mehler, Moenchengladbach (DE); Thomas Vetten, Duesseldorf (DE)

(73) Assignee: SIG TECHNOLOGY AG, Neuhausen am Rheinfall (CH)

( * ) Notice: Subject to any disclaimer, the term of this patent is extended or adjusted under 35 U.S.C. 154(b) by 0 days.

(21) Appl. No.: 16/090,353

(22) PCT Filed: Mar. 14, 2017

(86) PCT No.: PCT/EP2017/055982

§ 371 (c)(1),
(2) Date: Oct. 1, 2018

(87) PCT Pub. No.: WO2017/174304

PCT Pub. Date: Oct. 12, 2017

(65) Prior Publication Data

US 2019/0112092 A1 Apr. 18, 2019

(30) Foreign Application Priority Data

Apr. 4, 2016 (DE) ..... 10 2016 003 829

(51) Int. Cl.
*B65D 5/06* (2006.01)
*B65D 5/02* (2006.01)

(52) U.S. Cl.
CPC ..... *B65D 5/064* (2013.01); *B65D 5/029* (2013.01); *B65D 5/0209* (2013.01)

(58) Field of Classification Search
CPC ..... B65D 5/064; B65D 5/0209; B65D 5/029; B65D 5/067; B65D 5/4266; B65D 65/40; B29L 2031/7166

(Continued)

(56) References Cited

U.S. PATENT DOCUMENTS 3,827,623 A 8/1974 Arneson
4,568,018 A * 2/1986 Husnik ..... B65D 5/067 206/503

(Continued)

FOREIGN PATENT DOCUMENTS

CN 1057997 A 1/1992
CN 2263062 Y 9/1997

(Continued)

*Primary Examiner* — Christopher R Demeree
(74) *Attorney, Agent, or Firm* — The Webb Law Firm

(57) ABSTRACT

A carton sleeve of a composite material for producing a carton is illustrated and described, including: a sleeve area, a longitudinal seam that joins two edges of the composite material to form an all-round carton sleeve, and two pseudo fold lines that pass through the sleeve area, wherein the carton sleeve is folded along both pseudo fold lines. In order to allow the production of cartons with a more complex geometry, it is envisaged that the carton sleeve in the region of the sleeve area has no further or no continuous fold lines apart from the two pseudo fold lines. In addition a carton of such a carton sleeve as well as a method for producing a carton from such a carton sleeve are illustrated and described.

23 Claims, 11 Drawing Sheets

(58) Field of Classification Search
USPC ..... 229/126, 125.42, 137, 249, 915.1, 106, 229/125.04, 138, 213, 214, 248, 4.5
See application file for complete search history.

(56) References Cited

U.S. PATENT DOCUMENTS

| | | | | |
|---|---|---|---|---|
| 4,989,736 | A * | 2/1991 | Andersson | B65D 5/067 229/123.1 |
| 5,014,854 | A * | 5/1991 | Anderson | B65D 5/062 229/214 |
| 5,065,938 | A * | 11/1991 | Anderson | B65D 5/746 229/125.08 |
| 5,118,036 | A | 6/1992 | Mandersson | |
| 5,738,272 | A * | 4/1998 | Anchor | B65D 5/029 229/109 |
| 5,938,107 | A | 8/1999 | Anchor et al. | |
| 6,042,527 | A | 3/2000 | Anderson et al. | |
| 7,325,719 | B2 | 2/2008 | Palm | |
| 7,523,853 | B2 | 4/2009 | Kortsmit et al. | |
| 7,571,846 | B2 * | 8/2009 | Berglin | B65D 5/746 229/125.15 |
| 8,584,927 | B2 * | 11/2013 | Rinnondi | B65B 49/08 229/125.42 |
| 9,227,750 | B2 * | 1/2016 | Franic | B65D 5/029 |
| 9,399,536 | B2 * | 7/2016 | Bertone | B65D 5/068 |
| 9,452,859 | B2 * | 9/2016 | Franic | B65D 5/067 |
| 9,555,917 | B2 | 1/2017 | Wong et al. | |
| 9,611,065 | B2 * | 4/2017 | Franic | B65D 5/746 |
| 2011/0113733 | A1 | 5/2011 | Franic | |
| 2015/0048106 | A1 | 2/2015 | Crabill | |
| 2016/0376045 | A1 | 12/2016 | Seiche | |
| 2019/0337667 | A1 * | 11/2019 | Dammers | B65D 5/4266 |

FOREIGN PATENT DOCUMENTS

| | | | |
|---|---|---|---|
| CN | 1217695 | A | 5/1999 |
| CN | 1525923 | A | 9/2004 |
| CN | 1777538 | A | 5/2006 |
| CN | 201109520 | Y | 9/2008 |
| CN | 102056812 | A | 5/2011 |
| CN | 102099256 | A | 6/2011 |
| CN | 104245521 | A | 12/2014 |
| DE | 1052305 | B | 3/1959 |
| DE | 4033947 | A1 | 4/1992 |
| DE | 10125682 | A1 | 11/2001 |
| EP | 0027350 | A1 | 4/1981 |
| EP | 0144736 | A2 | 6/1985 |
| EP | 0936150 | A1 | 8/1999 |
| GB | 419077 | | 11/1934 |
| GB | 808223 | | 1/1959 |
| WO | 9732787 | A2 | 9/1997 |
| WO | 2008147499 | A1 | 4/2008 |
| WO | 2009101029 | A1 | 8/2009 |
| WO | 2009141389 | A2 | 11/2009 |
| WO | 2015003852 | A1 | 1/2015 |

* cited by examiner

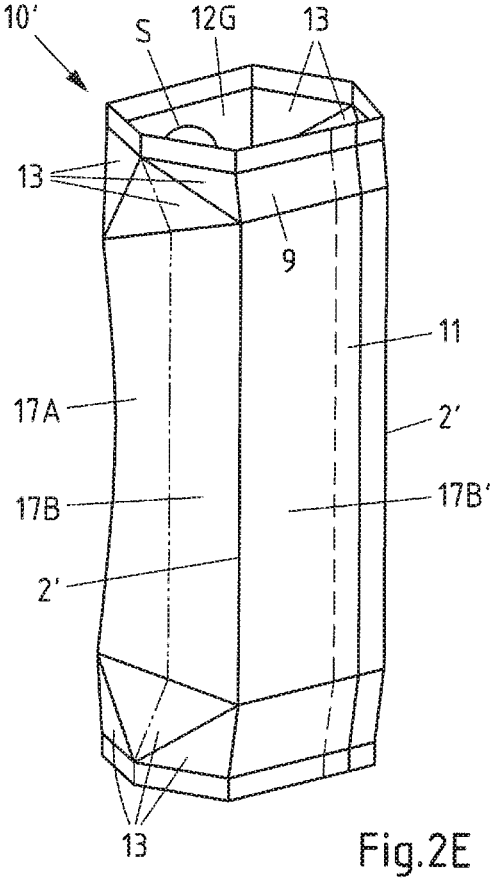
Fig.2E
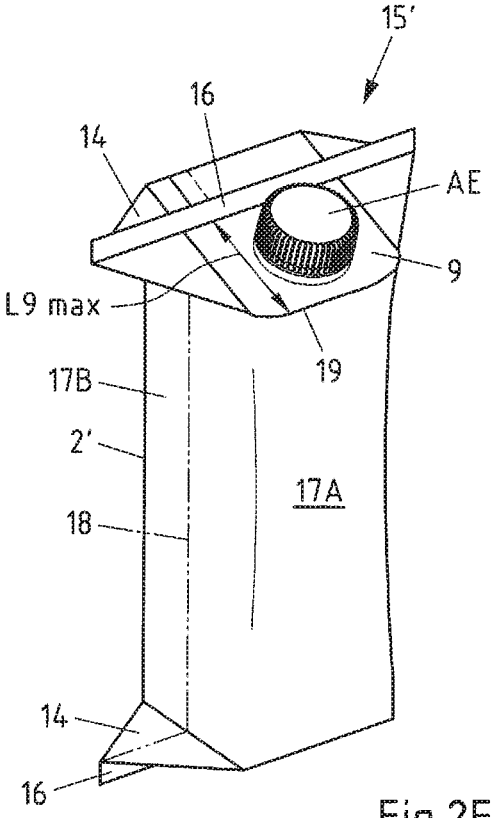
Fig.2F
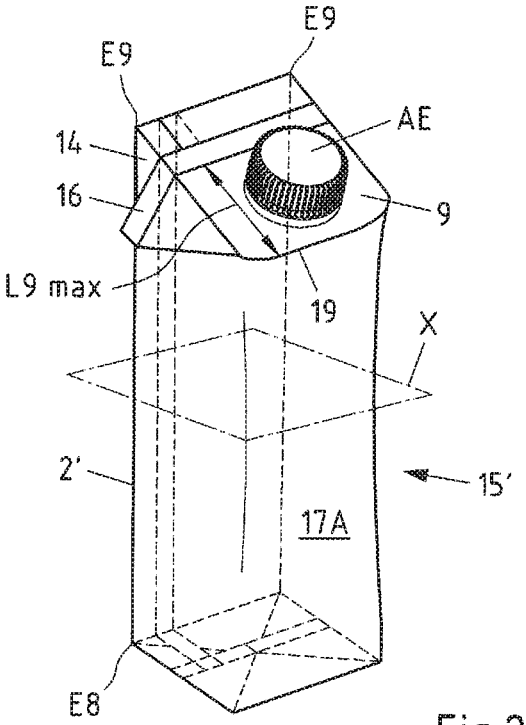
Fig.2G
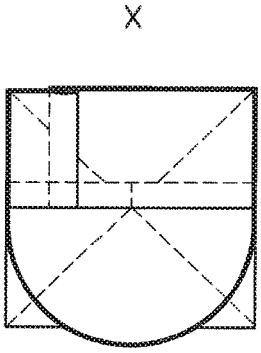

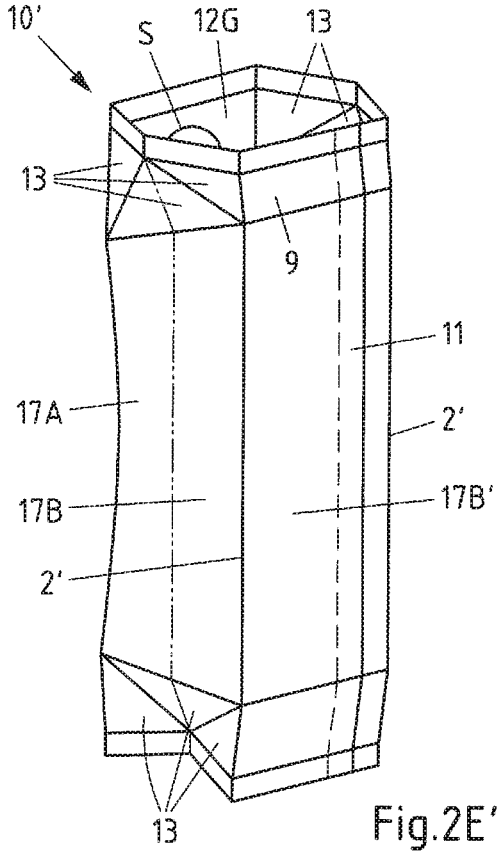
Fig.2E'
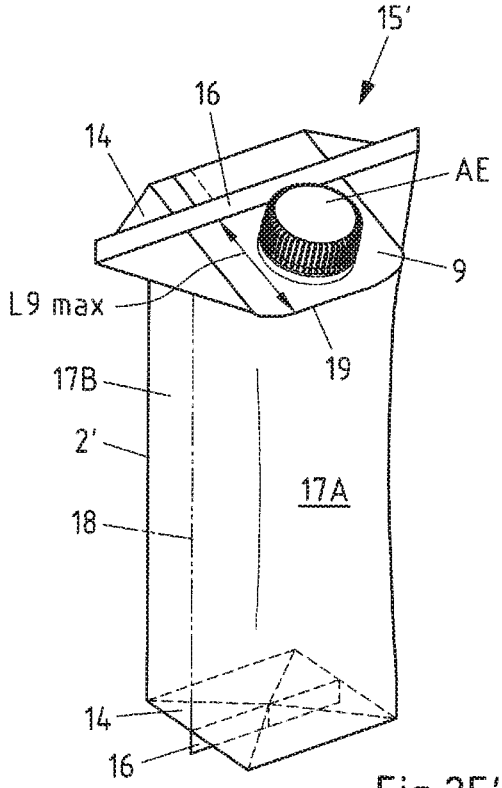
Fig.2F'
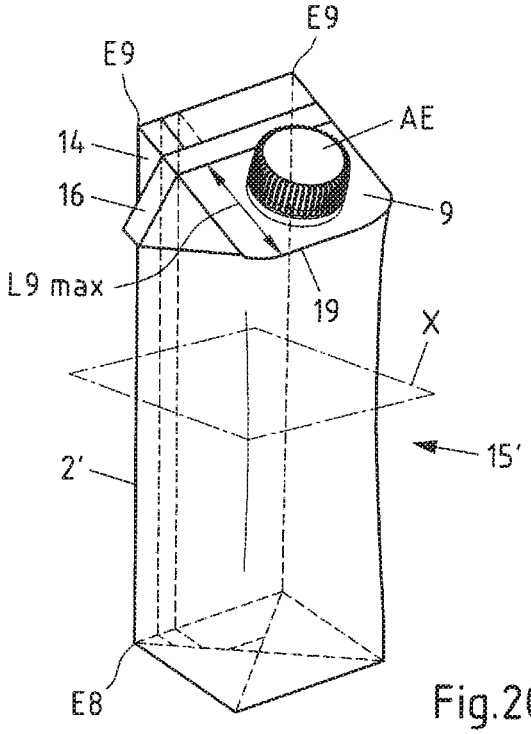
Fig.2G'
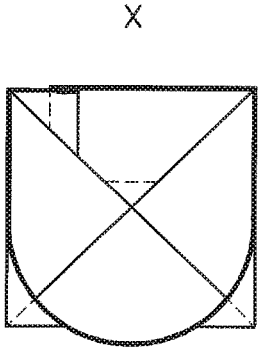

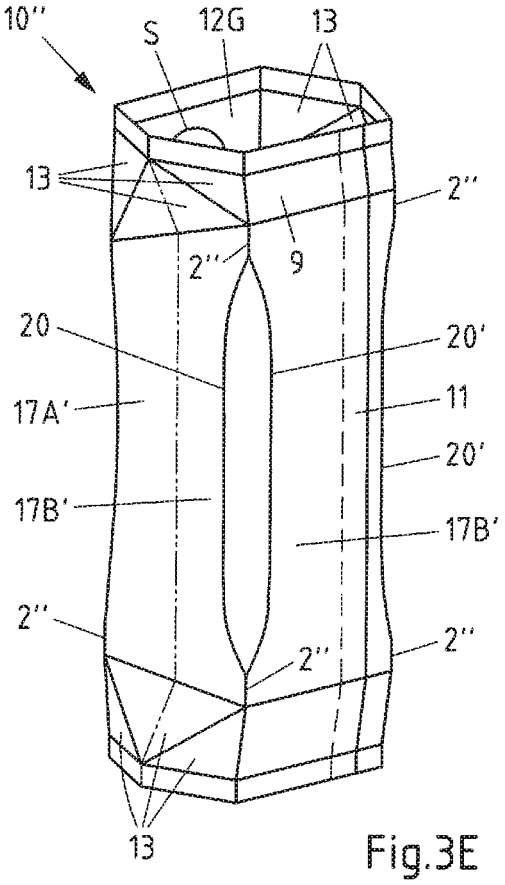
Fig.3E
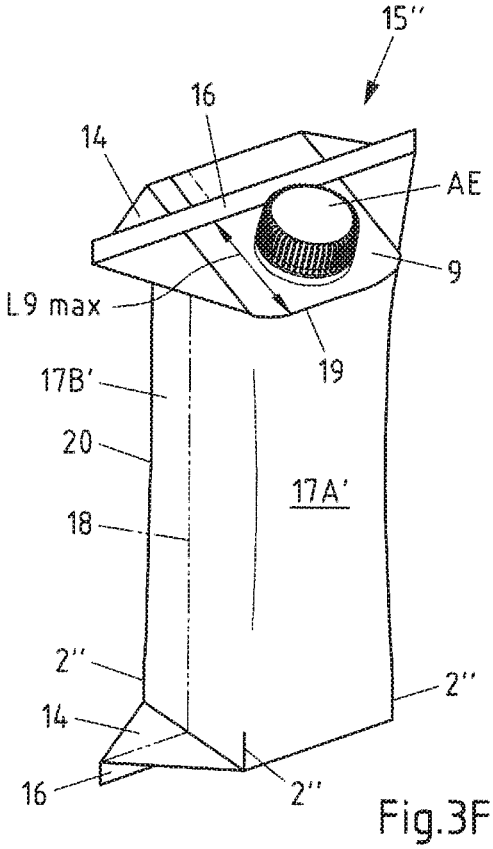
Fig.3F
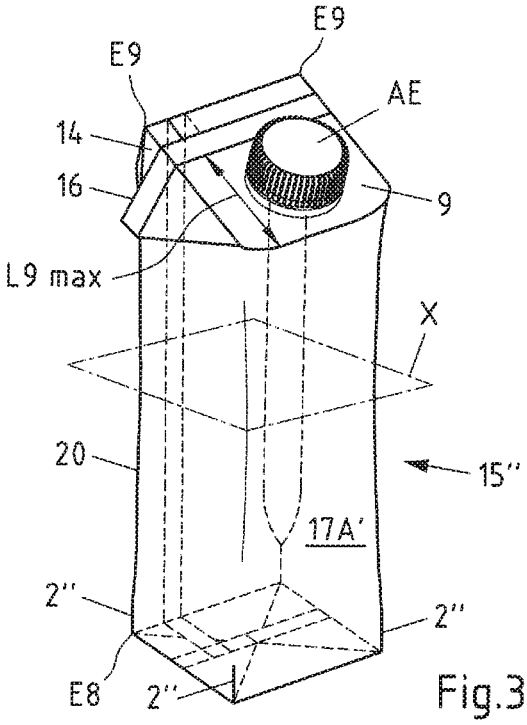
Fig.3G
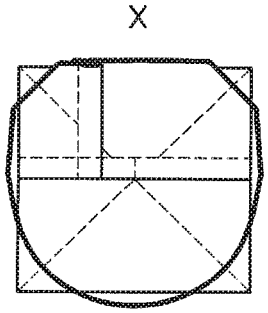

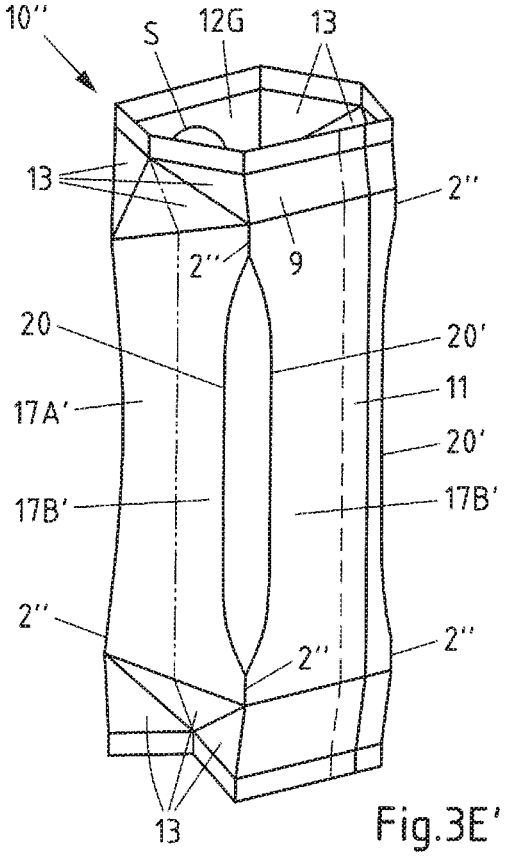
Fig.3E'
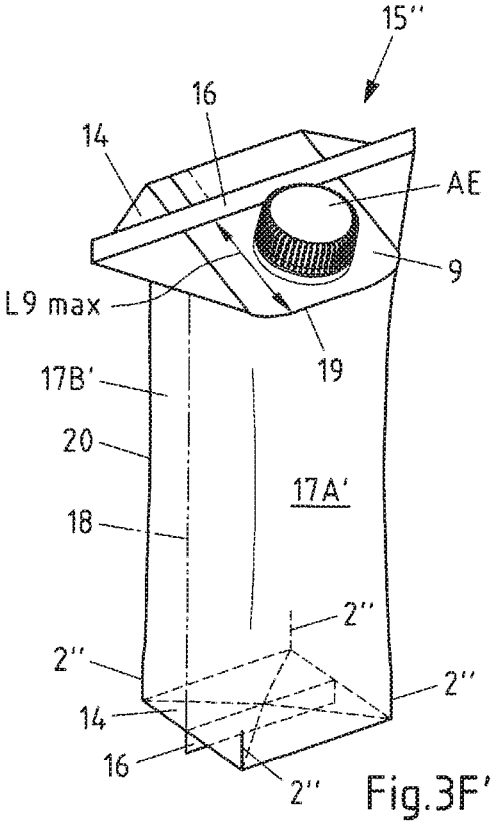
Fig.3F'
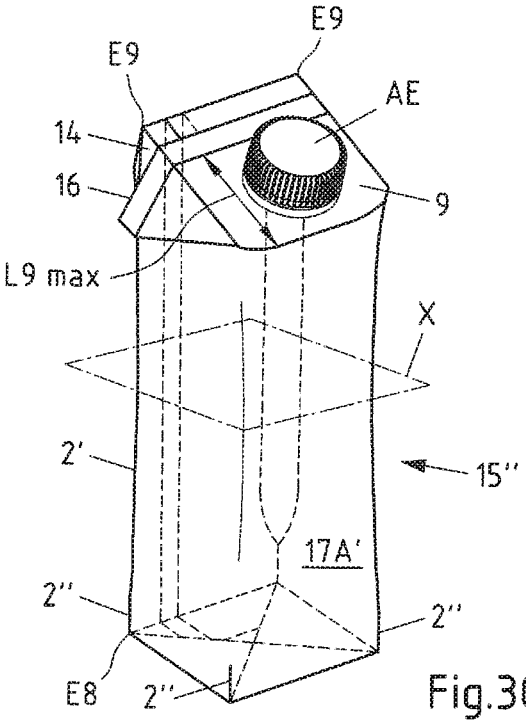
Fig.3G'
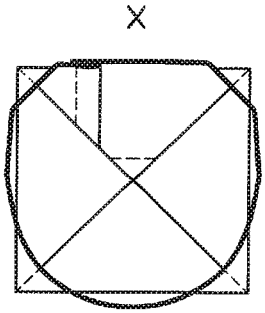

CARTON SLEEVE, CARTON AND METHOD FOR PRODUCING A CARTON

CROSS-REFERENCE TO RELATED APPLICATIONS

This application is the United States national phase of International Application No. PCT/EP2017/055982 filed Mar. 14, 2017, and claims priority to German Patent Application No. 10 2016 003 829.2 filed Apr. 4, 2016, the disclosures of which are hereby incorporated in their entirety by reference.

BACKGROUND OF THE INVENTION

The invention relates to a carton sleeve of a composite material for producing a carton, comprising: a sleeve area, a longitudinal seam that joins two edges of the composite material to form an all-round carton sleeve, and two pseudo fold lines which pass through the sleeve surface, wherein the carton sleeve is folded along both pseudo fold lines.

The invention also relates to a carton of a composite material, wherein the carton is produced from a previously mentioned carton sleeve and wherein the carton is closed in the region of the floor areas and in the region of the gable areas.

The invention finally relates to a method for producing a carton from a carton sleeve of a composite material.

Field of the Invention

Cartons can be produced in various ways and from a wide range of materials. A widely employed possibility for their production consists in producing a blank from the packaging material, from which by folding and further steps first of all a carton sleeve and finally a packaging is obtained, which when filled and closed forms a carton. This type of production has inter alia the advantage that the blanks and carton sleeve are very flat and can therefore be stacked and transported in a space-saving manner. In this way the blanks and carton sleeves can be produced in situ and the folding and filling of the carton sleeves can take place at another site. Composites are often used as material, for example a composite of several thin layers of paper, cardboard, plastic or metal, in particular aluminium. Such cartons have been known for a long time and are widely used in particular in the food industry.

Description of Related Art

A first production step often consists in forming an all-round carton sleeve from a blank by folding and sealing or bonding a seam. The folding of the blank normally takes place along embossed fold lines. The layer of the fold lines corresponds in this case to the layer of the edges of the packaging to be produced from the carton sleeve. This has the advantage that the blank and the carton sleeve are folded exclusively at places that are in any case folded in the finished packaging. A method for producing a packaging from a carton sleeve is known for example from WO 2015/003852 A9 (there in particular FIG. 1A to FIG. 1E). The packaging described there has a rectangular cross-sectional area ad is overall of cuboid shape.

Apart from packagings with rectangular cross-sectional areas, packagings with cross-sectional area that have more than four corners are also known. From EP 0 936 150 B1 or from U.S. Pat. No. 6,042,527A packagings with an octagonal cross-sectional area for example are known. The shape of the packagings is achieved by additional fold lines in the blanks.

A disadvantage of folding the carton sleeves along the subsequent packaging edges is however the fact that exclusively packagings with angular cross-sectional areas can be produced. In addition exclusively packagings can be produced whose cross-sectional area is identical in the vertical direction of the packaging. Alternative configurations, such as for example curves or freeform shapes instead of edges, are not possible however.

Carton sleeves ("sleeves") and packagings ("containers") produced therefrom are known from EP 0 027 350 A1. With the carton sleeve described there packagings can be produced whose cross-sectional area alters in the vertical direction (rectangular cross-sectional areas on the gable and on the floor, eight-cornered cross-sectional area in between). Also this packaging has however exclusively angular cross-sectional areas. Alternative configurations such as for example curves or freeform shapes instead of the edges are also not described in EP 0 027 350 A1. The carton sleeve described there in addition does not consist of a composite material, but of cardboard or corrugated board. An inner bag of plastic material is proposed for the filling with liquids.

Carton sleeves and packagings produced therefrom are also described in GB 808,223 A. There a long material strip of board is first of all provided with fold lines and is then coated with a plastic layer (FIG. 6). After the formation of a longitudinal seam (FIG. 7) the material strip is folded to form a tube with a rectangular cross-section (FIG. 8). The two side areas of the tube are then folded inwardly, whereby the tube adopts a flat shape (FIG. 9). Transverse running seams are produced at specified interspacings, along which the tube can be folded and thus forms a stack (FIG. 10). By separating the tube in the region of the transverse running seams individual carton sleeves are obtained, which are already closed on one side by the transverse running seam. A disadvantage of this procedure is the fact that the carton sleeves are already folded along six fold lines during their separation from the tube, four fold lines of which form the edges of the subsequent packaging. Also, these carton sleeves are therefore suitable only for producing packagings with rectangular cross-sectional areas.

A further carton sleeve and a packaging produced therefrom are described in WO 97/32787 A2. Also in the case of this carton sleeve numerous fold lines are however provided in the region of the sleeve area, some of which form the later edges of the packaging produced therefrom. Also, these carton sleeves are therefore only suitable for producing cartons with angular—remaining constant in the vertical direction—cross-sectional areas.

SUMMARY OF THE INVENTION

Against this background the object of the invention is to design the carton sleeve described in the introduction and previously explained in more detail hereinbefore, so that the production of cartons of a more complex geometry is made possible.

This object is achieved first of all with a carton sleeve according to the pre-characterising part of claim 1, in that in the region of the sleeve area the carton sleeve has no further fold lines between the two pseudo fold lines.

"Sleeve area" denotes that area that is located between the gable areas of the gable region and the floor areas of the floor region of the carton sleeve. In conventional cartons the sleeve area then therefore corresponds to the sum total of the front and rear sides as well as the two sides of a carton.

An alternative solution of the object is achieved with a carton sleeve according to the pre-characterising part of claim 2, in that the carton sleeve in the region of the sleeve area has no continuous fold lines between the two pseudo fold lines, and that on the other side of the carton sleeve at least one of the fold lines extends in a manner at least partially interrupted in sections, or in a divided, curved and/or uneven manner. "Continuous" fold lines are understood in this connection to mean fold lines that completely traverse the sleeve area, for example from the floor areas to the gable areas.

According to a further teaching of the invention, in accordance with the second alternative the fold lines arranged on the rear partial area are formed as fold line stumps. "Fold line stumps" are understood to mean short sections of fold lines that are arranged immediately adjacent to the floor area and/or the gable area. This has advantages when folding, closing and sealing, for example in the production of the floor region on a mandrel, since no leakages due to pockets or the like can occur in the corners.

In a further embodiment of the invention the fold lines arranged on the rear partial area are formed as divided fold lines that preferably run substantially parallel to one another. In this way the conventional edge regions with a substantially rectangular cross-section can be "dissolved" and replaced by polygonal cross-sections, which—especially in the case of the rear side of a beverage carton the contents of which are intended for immediate consumption—allows an ergonomic handling, since a "rounded off" or "beveled" rear side of the carton is adapted very well to the fingers gripping the carton.

The carton sleeve according to the invention consists in both alternatives of a composite material and serves for the production of a carton that is suitable for example for beverages or other liquid foods. In particular the carton sleeve can consist of a composite of several thin layers of paper, cardboard, plastic and/or metal, in particular aluminium, as an oxygen barrier. Preferably the carton sleeve is formed in one part. The carton sleeve includes a frontal continuous sleeve area, which in the case of a carton produced therefrom is arched towards the front and replaces the front area and parts of the two side areas.

The carton sleeve furthermore includes a longitudinal seam, which joins two oppositely lying ends of the composite material to form an all-round carton sleeve. By means of the longitudinal seam a tube-like carton sleeve closed in the circumferential direction can be produced from a flat, generally rectangular, blank. Preferably the composite material in the region of the longitudinal seam is turned down and "peeled" in a manner known per se at the inner end of the blank, and thus includes in this region fewer layers than in the remaining regions. In this way also the inner edge of the carton exposed to the product is reliably closed, so that no moisture can penetrate the composite material.

The carton sleeve has two openings, one in the region of the floor area and the other in the region of the gable area. The longitudinal seam can be produced for example by adhesion and/or welding. On account of the longitudinal seam such carton sleeves are also termed longitudinal seam-sealed carton sleeves.

The carton sleeve according to the invention furthermore has two "pseudo fold lines", which pass through the sleeve area. These pseudo fold lines should—like also conventional fold lines—facilitate the folding of the carton sleeve. These fold lines are termed "pseudo fold lines", since these are used only when folding the carton sleeve flat, but are folded straight again when unfolding to form the packaging to be filled. They can be formed by material weaknesses, wherein in order to maintain the liquid-tight state of the composite material no perforations but instead so-called "creases" are used. Creases are linear material displacements that are embossed or scored in the composite material with stamping or pressure tools. The two pseudo fold lines are straight and run parallel to one another. The carton sleeve is folded along both pseudo fold lines.

The invention is thus based on the idea of folding the carton sleeve not along fold lines that form the edges of the carton to be produced from the carton sleeve. The carton sleeve should therefore not be folded at fold lines that delimit the front area, the rear area and the two side areas of the carton from one another. Instead, real fold lines are completely or partially dispensed with in the region of the sleeve area and the carton sleeve should be folded exclusively along these pseudo fold lines, which however do not subsequently form edges of the carton. This makes possible a free configuration of the carton geometry and allows in particular cartons of virtually any arbitrary cross-sections to be produced. In particular the production of cartons with arched surfaces without fold lines is possible.

In a further embodiment of the carton sleeve it is envisaged that a carton sleeve is formed from a blank by folding along both pseudo fold lines by an angle of in each case about 180°. The folding by an angle of approximately 180° enables particularly flat carton sleeves to be obtained. This allows a space-saving stacking of carton sleeves, since these abut closely against one another and thus, with optimal utilisation of the volume, allow a transportation to the filling unit. In this way the carton sleeves can be produced at another site than the filling and production of the finished cartons. Preferably the carton sleeve is folded outwardly along both pseudo fold lines.

A further configuration of the carton sleeve is characterised by floor areas and gable areas that are arranged on opposite sides of the sleeve area. Preferably the gable areas—in the case of an upright packaging—are arranged above the sleeve area and the floor areas are arranged underneath the sleeve area.

With regard to this configuration of the carton sleeve it is furthermore proposed that the floor areas and the gable areas in each case include two rectangular areas or gable areas and six triangular areas. Preferably the rectangular areas and gable areas as well as the triangular areas are surrounded and bounded by fold lines. The rectangular areas serve for the folding of the floor and the gable of the carton. The triangular areas serve for folding excess composite material to form projecting "ears", which are then attached to the sides of the carton.

For this purpose it is furthermore proposed that the pseudo fold lines extend through the point of contact of three adjacent triangular areas of the floor area and through the point of contact of three adjacent triangular areas of the gable areas. This arrangement of the pseudo fold lines has the advantage that the pseudo fold lines at one point pass through the floor area and the gable area, at which these areas in any case have to be folded, for example to form "ears". The folding of the carton sleeve along the pseudo fold lines therefore already leads to a "pre-folding" of the fold line passing centrally through the "ears". A further advantage of the central arrangement of the pseudo fold lines is that the pseudo fold lines delimit as little as possible the space for the arrangement of the edge regions of the packaging. It may be envisaged that two of the triangular areas of the floor area and/or of the gable area are of approximately the same size. Alternatively it may be envisaged that all three triangular areas of the floor area and/or of the gable area have different sizes.

According to a further teaching of the invention it is envisaged that the gable area on the rear side of the carton sleeve has a shorter length than the length of the gable area on the front side of the carton sleeve. This arrangement means that the front area of the carton has a lesser height than the rear area of the carton. The carton thus has a forwardly slanting inclined upper side ("slanting gable carton").

In a further embodiment of the invention the front side of the carton sleeve has a front gable area, which is demarcated relative to the sleeve area by a front edge that is convexly curved at least over some sections. In this way the gable area, which of course is bounded at the rear by the bridge seam, is enlarged towards the front and thus allows the attachment of a pouring element with a relatively large diameter. In addition the front gable area can also have convexly curved embossed lines in the upper corner regions, whereby the gable area adopts a uniform shape resembling an ellipse, in the middle of which a pouring element can be arranged. For this purpose a zone of weakness, for example as a so-called "prelaminated hole" is expediently provided centrally on the front gable area.

A further embodiment of the carton sleeve envisages that the pseudo fold lines are scored on the outside of the carton sleeve and the fold lines of the rear side of the carton sleeve are scored on the inside of the carton sleeve. This leads to a simpler production in the scoring or embossing treatment of the composite material strip before the cutting of the individual blanks. Also, a combination of scoring directions and also embossing directions can be provided.

The object described hereinbefore is also achieved by a carton of a composite material, in which the carton is produced from a carton sleeve according to any one of claims 1 to 14, and wherein the carton is closed in the region of the floor areas and in the region of the gable areas. The carton is characterised in that the carton has no continuous straight fold lines in the region of the sleeve area.

Since the carton is produced from one of the carton sleeves described hereinbefore, many properties and advantages of the carton sleeve also exist in the carton. A particular advantage is the fact that the carton has no angular fold edges in the region of its sleeve area, even though it was produced from a carton sleeve that is folded at two points. This is achieved in that in the production of the carton the carton sleeve is "folded back" along the two pseudo fold lines, so that the partial regions of the sleeve area adjoining the pseudo fold lines in each case again transform somewhat continuously into one another. The pseudo fold lines thus do not form the edges of the carton but lie—scarcely visible—in its sleeve area. Instead of straight, angular fold edges a carton with an individually shaped, for example curved, sleeve area, should thus be obtained. In particular it can be envisaged that the carton has no fold lines at all in the region of the sleeve area. Preferably the carton is formed in one piece. In particular, preferably the part of the carton produced from the composite material is in any case formed in one piece. This part of the carton can be supplemented by further elements, for example by an opening, pouring and closure element (e.g. a hinged flap closure or screw cap) or a drinking aid (e.g. a drinking straw).

In one embodiment of the carton it is envisaged that the partial regions of the sleeve area adjoining the pseudo fold lines are in each case arranged with respect to one another in an angular range between 160° and 200°, in particular between 170° and 190°. A particular advantage of this configuration is the act that the carton has no fold lines and therefore no angular edges on its sides. This is achieved by the fact that in the production of the carton the carton sleeve is "folded back" along the two pseudo fold lines, so that the partial regions of the sleeve area adjoining the pseudo fold lines are arranged approximately in the same plane.

A further embodiment of the carton is characterised by ears, which are attached in the lower region of the carton to the floor areas. Alternatively or in addition the carton is characterised by ears that are attached in the upper region of the carton to the side areas of the sleeve. In the lower region of the carton the ears can be attached in a different way to the floor area: one floor variant envisages that the ears are folded underneath the rectangular areas of the floor, formed slightly arched relative to the latter in the manner of a dome, and are fastened there. Another floor variant envisages inwardly directed ears however, which are arranged above the subsequently folded rectangular areas of the floor. The first variant has the advantage that the ears are securely pressed against the carton by the intrinsic weight of the filled carton, whereas the second variant provides a floor with a particularly smooth standing area. The arrangement of the upper ears on the side sleeve areas has the advantage that a pouring element can be arranged on the upper side of the carton.

The object described in the introduction is also achieved by a method for producing a carton from a carton sleeve of a composite material. The method comprises in this connection at least the following steps:

Provision of a carton sleeve according to any one of claims 1 to 14 and

Folding back the sleeve area of the carton sleeve along both pseudo fold lines.

The method can in addition also include the following steps:

Sealing the carton sleeve in the region of the floor areas,

Optional attachment of a pouring element,

Filling of the carton, and

Sealing the carton sleeve in the region of the gable area.

As has already been described hereinbefore, the method is also based on the idea of producing a carton from a carton sleeve whose pseudo fold lines do not form edges of the carton produced therefrom. This is made possible by the fact that the carton sleeve folded along the pseudo fold lines is "folded back", whereby the folding along the pseudo fold lines is cancelled. The pseudo fold lines provided in the carton sleeve thus do not form an edge of the carton. This allows the production of cartons having a more complicated geometry.

According to a further embodiment of the method it is finally proposed that the partial regions of the sleeve area adjoining the pseudo fold lines after the folding back lie again in each case in an angular range between 160° and 200°, in particular between 170° and 190°. The partial regions of the sleeve area should therefore be folded back along the pseudo fold lines until the sleeve area has almost continuous transitions between the partial regions of the sleeve area.

BRIEF DESCRIPTION OF THE DRAWINGS

The invention is described in more detail hereinafter with the aid of a simply preferred exemplary embodiment. In the drawings the figures show:

FIG. 2E: the carton sleeve from FIG. 2D with outwardly pre-folded floor and gable areas, in a perspective rear view, FIG. 2F: a first embodiment of a carton according to the invention, which is formed from the carton sleeve shown in FIG. 2E, after the closing and with attached opening, pouring and closure element, in a perspective front view, FIG. 2G: the carton of FIG. 2F with attached upper ears and folded-in lower ears, FIG. 2E': the carton sleeve from FIG. 2 with inwardly pre-folded floor areas and outwardly pre-folded gable areas, in a perspective rear view, FIG. 2F': a further embodiment of a carton according to the invention, which is formed from the carton sleeve shown in FIG. 2E', after the closing and with attached opening, pouring and closure element, in a perspective front view, FIG. 2G': the carton of FIG. 2F' with attached upper ears and attached lower fin seal, FIG. 3E: the carton sleeve from FIG. 3D with outwardly pre-folded floor and gable areas, in a perspective rear view, FIG. 3F: a first embodiment of a carton according to the invention, which is formed from the carton sleeve shown in FIG. 3E, after the closing and with attached opening, pouring and closure element, in a perspective front view, FIG. 3G: the carton from FIG. 3F with attached upper ears and folded-in lower ears, FIG. 3E': the carton sleeve from FIG. 3D with inwardly pre-folded floor areas and outwardly pre-folded gable areas, in a perspective rear view, FIG. 3F': a further embodiment of the carton according to the invention, which is formed from the carton sleeve shown in FIG. 3E', after the closing and with attached opening, pouring and closure element, in a perspective front view, and FIG. 3G': the carton of FIG. 3F' with attached upper ears and applied lower fin seal.

DESCRIPTION OF THE INVENTION

Figure 1A:
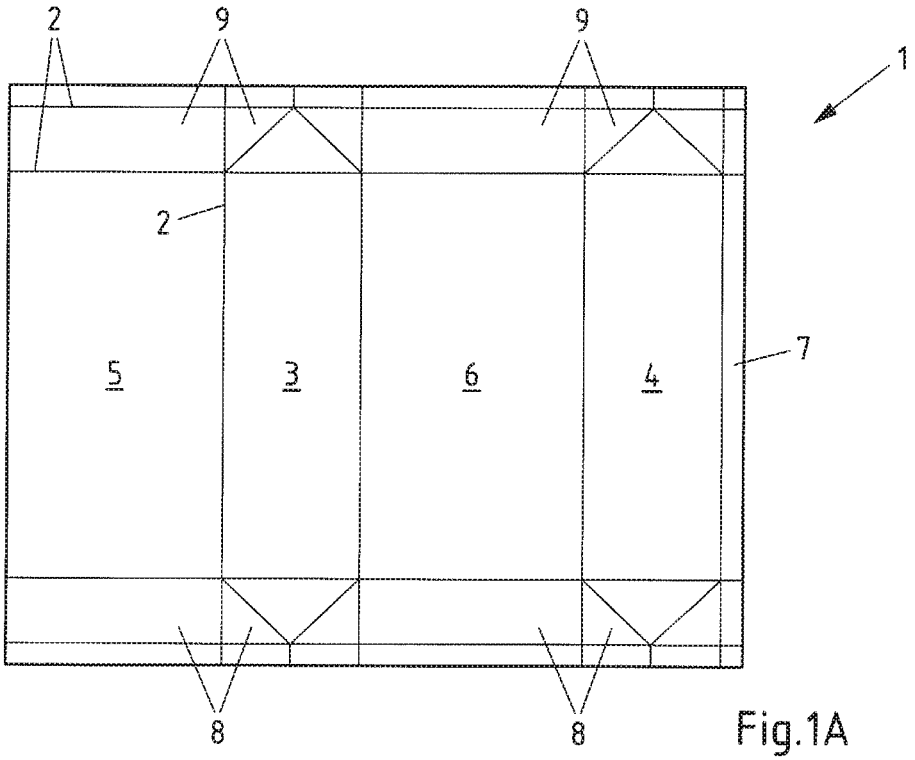
Fig.1A Prior Art
FIG. 1A: a blank known from the prior art for folding a carton sleeve.

In FIG. 1A a blank 1 known from the prior art is shown, from which a carton sleeve can be formed. The blank 1 can include several layers of different materials, for example paper, cardboard, plastic or metal, in particular aluminium. The blank 1 has several fold lines 2, which are intended to facilitate the folding of the blank 1 and which subdivide the blank 1 into several areas. The blank 1 can be subdivided into a first side area 3, a second side area 4, a front area 5, a rear area 6, a sealing area 7, floor areas 8 and gable areas 9. A carton sleeve can be formed from the blank 1, in which the blank 1 is folded in such a way that the sealing area 7 can be joined, in particular welded, to the front area 5.

Figure 1B:
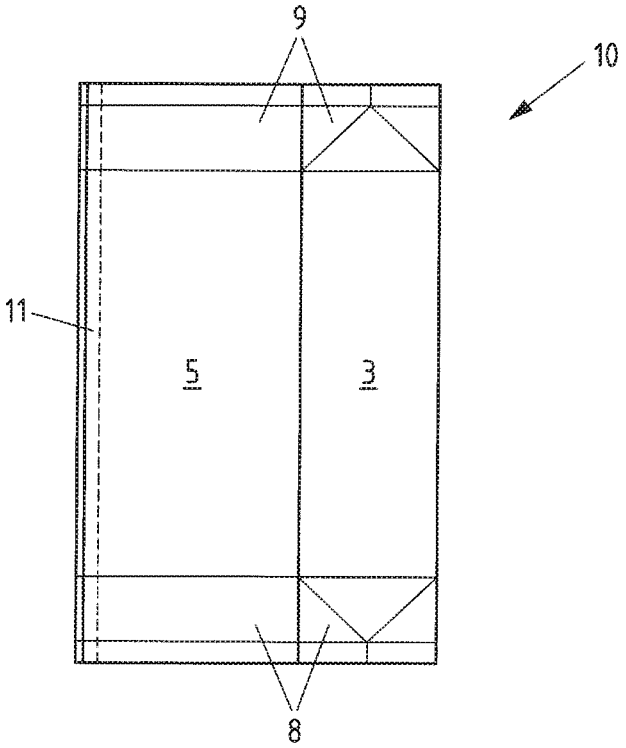
Fig.1B Prior Art
FIG. 1B: a carton sleeve known from the prior art, which is formed from the blank illustrated in FIG. 1A, in the folded flat state.

FIG. 1B shows a carton sleeve 10 known from the prior art in the state when folded flat. The regions of the carton sleeve already described in connection with FIG. 1A are provided with corresponding reference numerals in FIG. 1B. The carton sleeve 10 is formed from the blank 1 shown in FIG. 1A. For this purpose the blank 1 is folded in such a way that the sealing area 7 and the front area 5 are arranged overlapping, so that the two areas can be welded flat with one another. As a result a longitudinal seam 11 is formed. In FIG. 1B the carton sleeve 10 is shown in a flat, folded-together state. In this state one side area 4 (hidden in FIG. 1B) lies underneath the front area 5, while the other side area 3 lies on the rear area 6 (hidden in FIG. 1B). In the flat, folded-together state a plurality of carton sleeves 10 can be stacked and transported in a particularly space-saving manner. Accordingly the carton sleeves 10 are often stacked at the production site and transported in the stacked state to the filling site. Only there are the carton sleeves 10 separated and unfolded, so as to be able to be filled with a product, for example with a beverage.

Figure 1C:
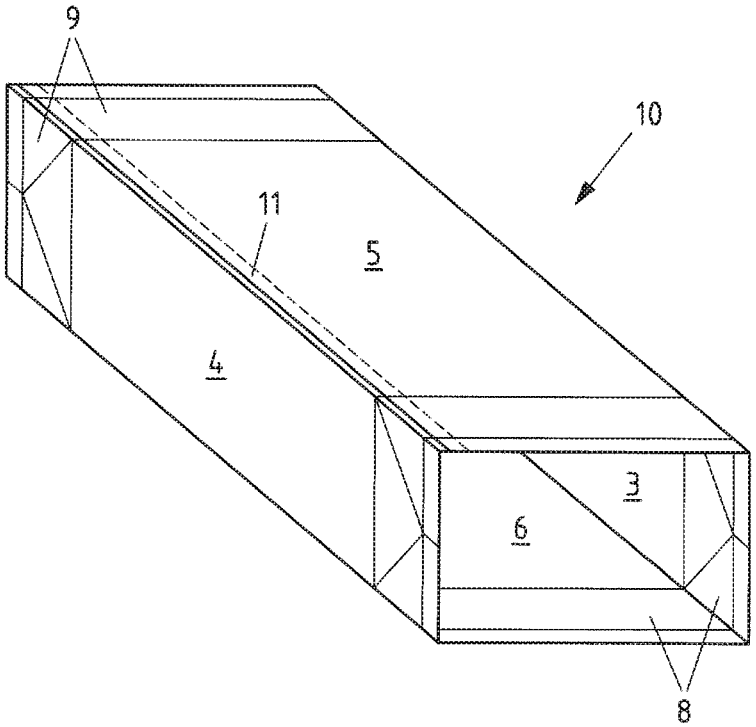
Fig.1C Prior Art
FIG. 1C: the carton sleeve of FIG. 1B in the unfolded state.

In FIG. 1C the carton sleeve 10 of FIG. 1B is illustrated in the unfolded state. Here too the regions of the carton sleeve 10 already described in connection with FIG. 1A or FIG. 1B are provided with corresponding reference numerals. The unfolded state is understood to mean a configuration in which an angle of about 90° is formed between the two respectively adjacent areas 3, 4, 5, 6, so that the carton sleeve 10—depending on the shape of these areas—has a square or rectangular cross-section. Corresponding to this the oppositely lying side areas 3, 4 are arranged parallel to one another. The same applies to the front area 5 and the rear area 6.

Figure 1D:
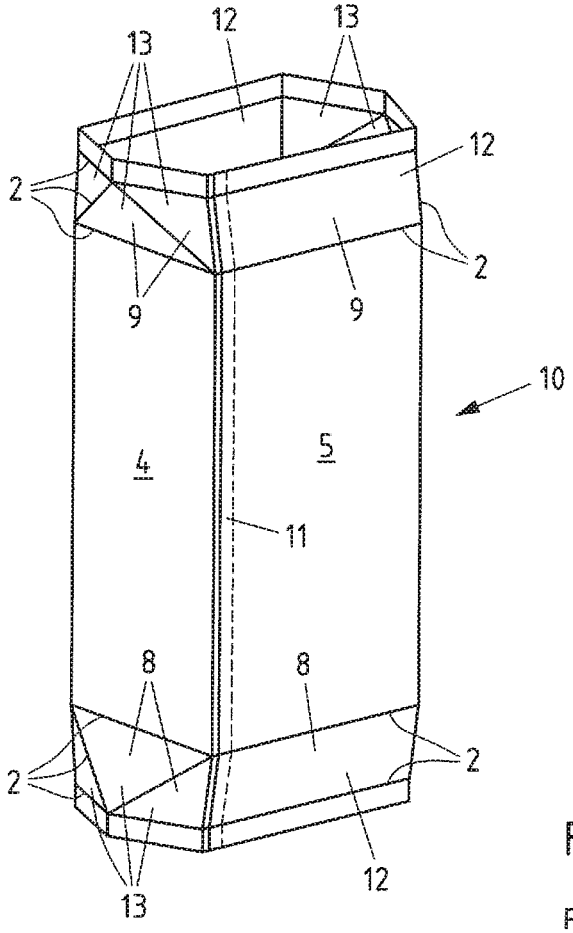
Fig.1D Prior Art
FIG. 1D: the carton sleeve of FIG. 1C with pre-folded floor and gable areas.

FIG. 1D shows the carton sleeve 10 of FIG. 1C in the pre-folded state, i.e. in a state in which the fold lines 2 in the region of the floor areas 8 and also in the region of the gable areas 9 have been pre-folded. Those regions of the floor areas 8 and of the gable areas 9 that adjoin the front area 5 and the rear area 6, are also termed rectangular areas 12. The rectangular areas 12 are folded inwardly during the pre-folding and subsequently form the floor and the gable of the carton. Those regions of the floor areas 8 and of the gable areas 9 that adjoin the side areas 3, 4, are on the other hand termed triangular areas 13. The triangular areas 13 are folded outwardly during the pre-folding and form projecting regions of excess material, which are also termed "ears" 14 and can be attached to the carton sides, for example by a bonding process, in a subsequent production step.

Figure 1E:
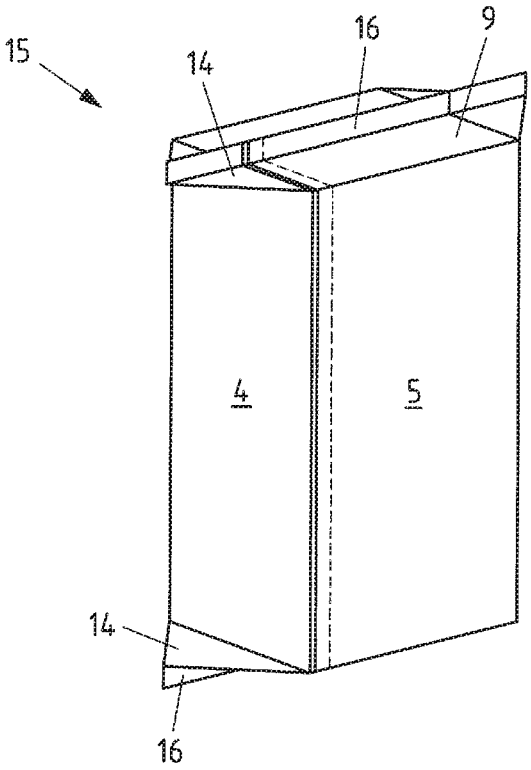
Fig.1E Prior Art
FIG. 1E: a carton known from the prior art, which is formed from the blank shown in FIG. 1A, after the welding.

FIG. 1E shows a carton 15 known from the prior art, which is formed from the blank shown in FIG. 1A. The carton 15 is shown after the sealing, i.e. in the filled and closed state. In the region of the floor areas 8 and in the region of the gable areas 9 a fin seal 16 is formed after the closing. The ears 14 and the fin seal 16 are shown projecting in FIG. 1E. The ears 14 as well as the fin seal 16 are attached in a subsequent production step, for example by a bonding technique, and in this connection also only the ears 14 can be sealed on, whereby the fin seal 16 is necessarily displaced towards the side.

Figure 1F:
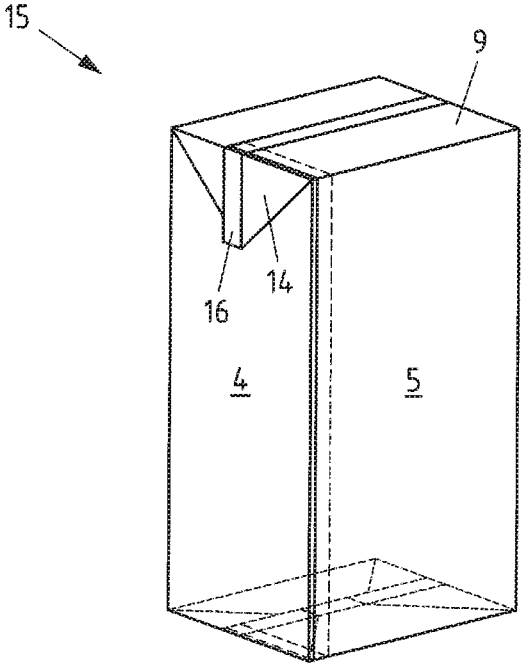
Fig.1F Prior Art
FIG. 1F: the carton from FIG. 1E with attached ears.

FIG. 1F shows the carton 15 of FIG. 1E with attached ears 14. In addition the fin seals 16 are also attached to the carton 15. The upper ears 14 arranged in the region of the gable area 9 are turned down and attached flat to the two side areas 3, 4. Preferably the upper ears 14 are bonded or welded to the two side areas 3, 4. The lower ears 14 arranged in the region of the floor area are also turned down, but are however attached flat to the dome-shaped curved lower side of the carton 15, which is formed by two rectangular areas 12 of the floor area 8. Preferably also the lower ears 14 are bonded or sealed to the carton 15, in particular to the rectangular areas 12.

Figure 2A:
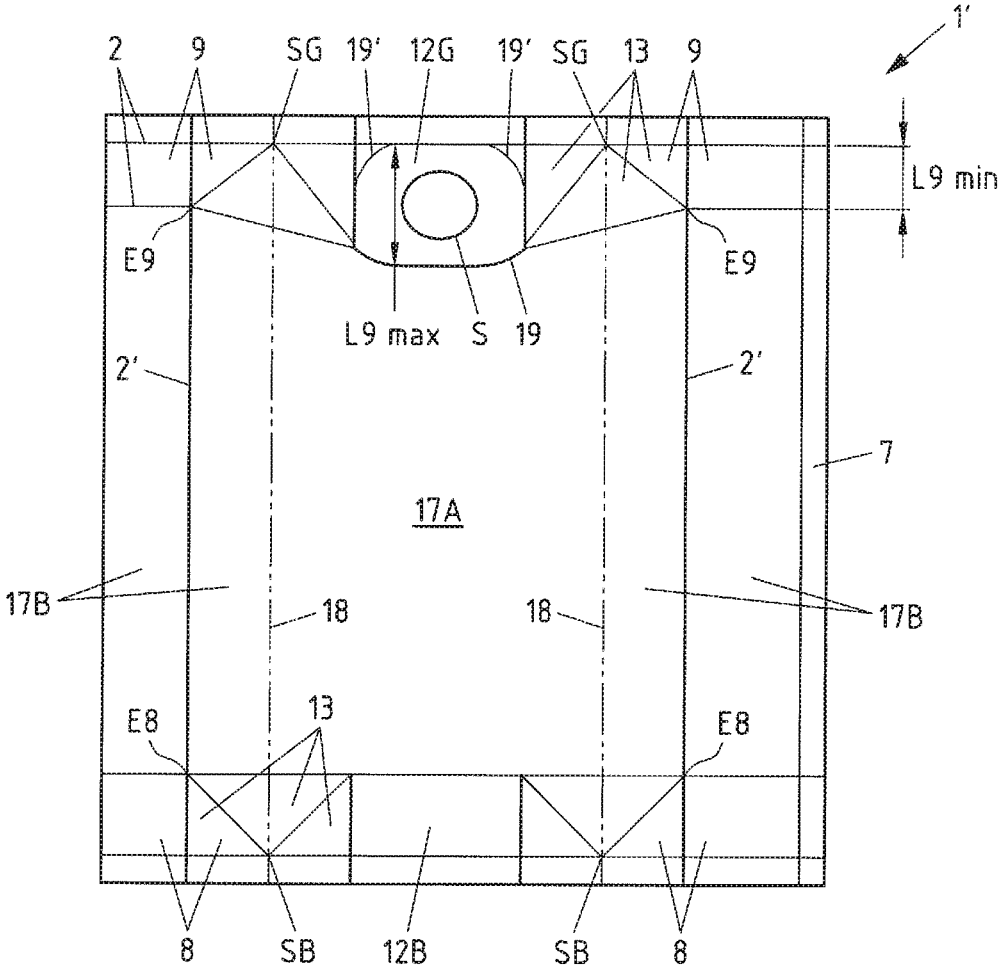
FIG. 2A: a blank for the production of a first embodiment of a carton sleeve according to the invention.

FIG. 2A shows a blank 1' for the production of a first arrangement of a preferred exemplary embodiment of a carton sleeve according to the invention. The regions of the blank already described in connection with FIG. 1A to FIG. 1F are provided in FIG. 2A with corresponding reference numerals. The floor area 8 and the gable area 9 remain unaltered in the blank 1' compared to the blank 1 of FIG. 1A.

A first difference is however the fact that the two side areas 3, 4, the front area 5 and the rear area 6, are combined to form a single sleeve area 17. The sleeve area 17 extends—apart from the sealing area 7—over the whole width of the blank 1'.

A second difference is the fact that the blank 1' has two pseudo fold lines 18 in the region of the sleeve area 17. The two pseudo fold lines 18 extend parallel to one another and pass through a point of contact SB of three adjacent triangular areas 13 of the floor area 8 and through a point of contact SG of three adjacent triangular areas 13 of the gable areas 9. The sleeve area 17 is subdivided into an inner partial area 17A and into two outer partial areas 17B by the pseudo fold lines 18. The inner partial area 17A lies between both pseudo fold lines 18 and the outer partial areas 17B lie outside the two pseudo fold lines 18.

A further difference is in the shape of the gable area 9: whereas the length L8 of the floor area 8 is constant over the whole width of the blank 1', the length of the gable area 9 adopts different values. Adjoining the outer partial regions 17B of the sleeve area 17, the gable area 9 has a reduced length L9. Adjoining the inner partial region 17*a* of the sleeve area 17 the gable area 9 on the other hand has an enlarged length L9 max. This configuration means that the inner partial region 17A has a lower height than the outer partial regions 17B. An inclined, slanted forwardly area is formed for the carton to be produced.

Instead of the rectangular area 12 in the gable region of the known carton sleeve according to FIG. 1D, the front gable area in the illustrated and to this extent preferred exemplary embodiment is formed from a gable area 12G with a front edge 19 that is convexly curved at least over some sections. In the upper corner regions of the gable area 12G two curved embossed lines 19' can be recognised, which confer on the gable area 12G a graceful shape resembling an ellipse. A circular line of weakness S is show centrally within this gable area 12G. In this connection this is preferably a circular recess in the carrier material, which is spanned by the remaining plastic and optionally aluminium layers of the composite material, to form a so-called "prelaminated hole". Its diameter can be matched to the size of the cutting element of a pouring element to be applied around the line of weakness, or can be formed relatively small in order to allow the insertion of a drinking straw.

The floor areas 8 have two corner points E8 and the gable area 9 have two corner points E9. The corner points E8, E9 form corner points of the carton to be produced from the blank 1'. With each corner point E8 of a floor area 8 there is associated a corresponding corner point E9 of a gable area 9, which is respectively that corner point E9 that is arranged above this corner point E8 when the carton is upright. A fold line 2' passes through in each case two corresponding corner points E8, E9, the said fold line serving for the formation of a rear (vertically extending) edge of the carton to be produced. However, in the blank 1' shown in FIG. 2A—as well as in the carton sleeve produced therefrom and the carton produced therefrom—only two continuous fold lines 2' are present. According to the first teaching of the invention no fold lines are provided between the further corner points of the floor areas 8 and the corresponding corner points of the gable areas 9, i.e. on the font sleeve area 17A.

Figure 2B:
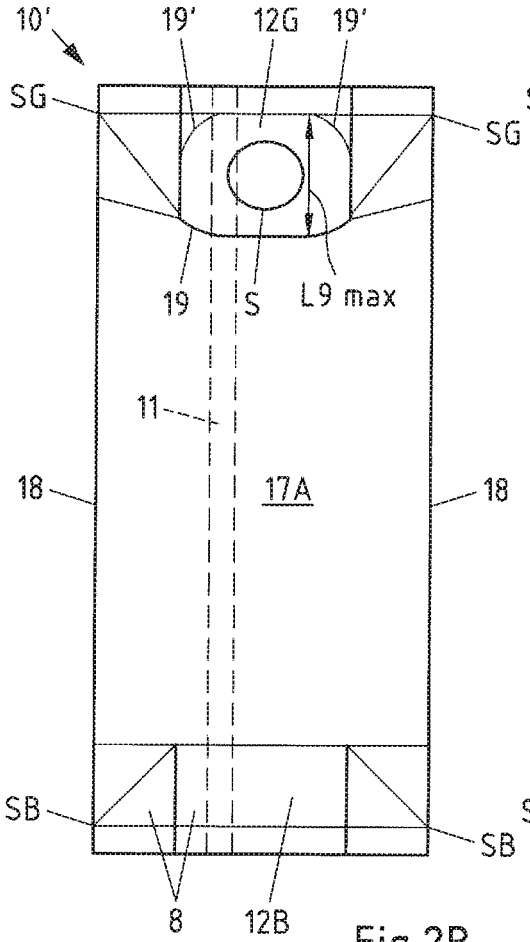
FIG. 2B: a carton sleeve that is formed from the blank shown in FIG. 2A, in a front view.

FIG. 2B shows a first arrangement of a carton sleeve 10' according to the invention, which is formed from the blank 1' shown in FIG. 2A, in a front view. The regions of the carton sleeve 10 already described in connection with FIG. 1A to FIG. 2A are provided in FIG. 2B with corresponding reference numerals. The carton sleeve 10' is formed in two steps from the blank 1': first of all the blank 1' is folded along the two pseudo fold lines 18. Then the two partial regions 17A, 17B of the sleeve area 17 are joined, in particular welded, to one another in the region of the sealing area 7, whereby a longitudinal seam 11 (hidden in FIG. 2B) is formed. The carton sleeve 1' thus has a surrounding structure closed in the circumferential direction, with an opening in the region of the floor area 8 and with an opening in the region of the gable area 9. In the front view the inner partial region 17A of the sleeve area 17 is visible, which is bounded on both sides by the pseudo fold lines 18. The remaining partial regions 17B of the sleeve surface 17 are hidden on the rear side of the carton sleeve 10' and are therefore hidden in FIG. 2B.

Figure 2C:
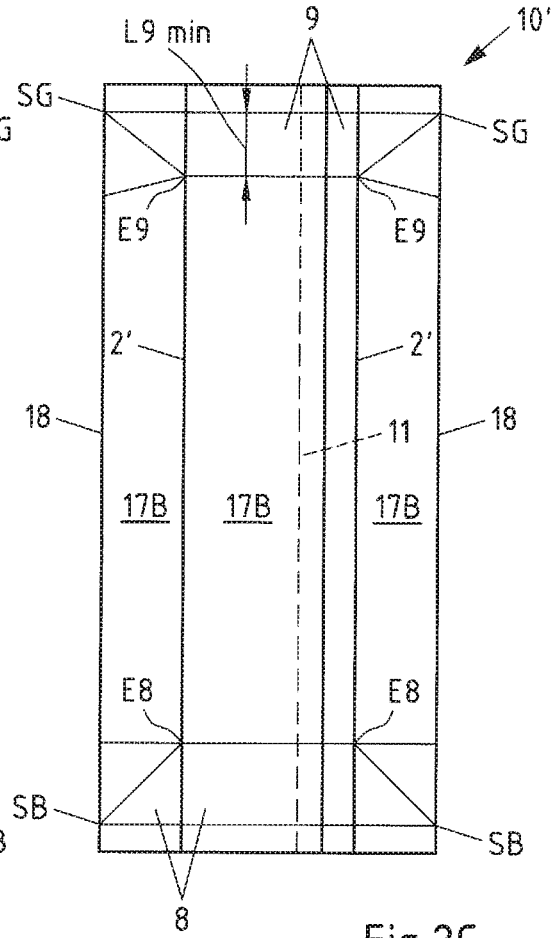
FIG. 2C: the carton sleeve of FIG. 2B in a rear view.

In FIG. 2C the carton sleeve 1' of FIG. 2B is illustrated in a rear view. The regions of the carton sleeve already described in connection with FIG. 1A to FIG. 2B are provided in FIG. 2C with corresponding reference numerals. In the rear view the two outer partial regions 17B of the sleeve area 17 are visible, which are joined to one another by the longitudinal seam 11 and are bounded on both sides by the pseudo fold lines 18. The front partial region 17A of the sleeve area 17 is hidden on the front side of the carton sleeve 10' and is therefore hidden in FIG. 2C.

Figure 2D:
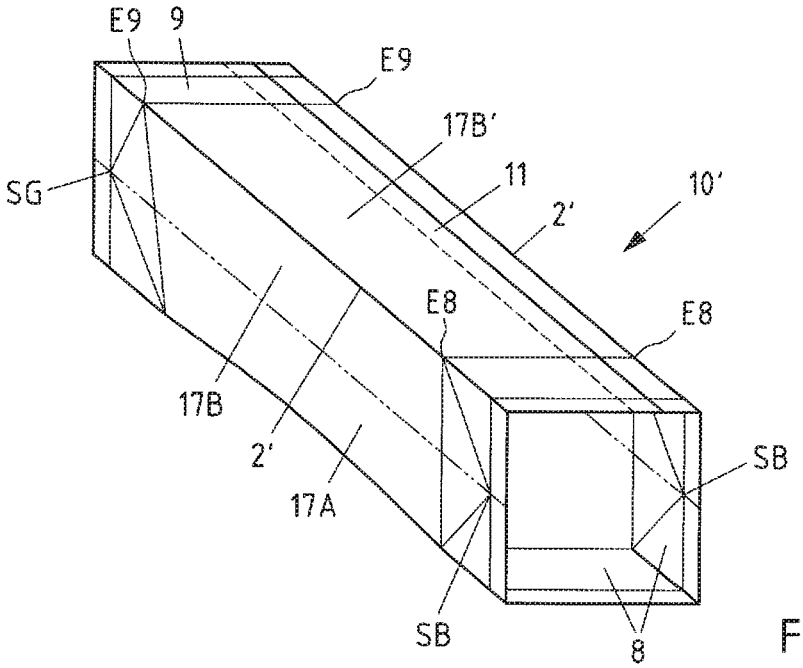
FIG. 2D: the carton sleeve of FIG. 2B and FIG. 2C in the unfolded state.

FIG. 2D shows the carton sleeve 1' of FIG. 2B and FIG. 2C in the unfolded state. The regions of the carton sleeve already descried in connection with FIG. 1A to FIG. 2C are provided in FIG. 2D with corresponding reference numerals. The unfolded state is achieved by folding back the carton sleeve 1' along the pseudo fold lines 18 passing through the sleeve area 17. The folding back takes place with an angle of about 180°. The folding back along the pseudo fold lines 18 has the result that the two partial regions 17A, 17B of the sleeve area 17 adjoining the pseudo fold line 18 no longer lie flat against one another, but are arranged in the same plane. The carton sleeve 10' is therefore folded only in its flat state (FIG. 2B, FIG. 2C) along the pseudo fold lines 18; in the unfolded state (Fig. D) the carton sleeve 10' (just like the carton to be produced therefrom) is on the other hand no longer folded along the pseudo fold lines 18. Hence the expression "pseudo" fold lines 18.

In FIG. 2E the carton sleeve 10' of FIG. 2D is illustrated with pre-folded floor and gable areas. The regions of the carton sleeve already described in connection with FIG. 1A to 2D are provided in FIG. 2E with corresponding reference numerals. The pre-folded state denotes (as in FIG. 1D) a state in which the fold lines 2 have been pre-folded in the region of the floor areas 8 and also in the region of the gable areas 9. The rectangular areas 12 are folded inwardly during the pre-folding and subsequently form the floor and the gable of the carton. The triangular areas 13 are folded outwardly during the pre-folding and form projecting regions of excess material, which are termed "ears" 14, and in a subsequent production step are attached to the side areas of the carton, for example by a bonding technique.

FIG. 2F shows a first arrangement of a carton 15' according to the invention, which is formed from the carton sleeve 10' shown in FIG. 2B, after the welding. The regions of the carton already described in connection with FIG. 1A to FIG. 2E are provided in FIG. 2E with corresponding reference numerals. The carton 15' is shown after the welding, i.e. in the filled and closed state. On account of the increased length L9 max of the gable area 9 in its area adjoining the inner partial region 17A of the sleeve area 17 as well as the reduced length L9 min of the gable area 9 in its region adjoining the outer partial regions 17B of the sleeve area 17, an enlarged gable area is formed. On this gable area the carton 15' is provided with a pouring element AE, which extends almost as far as the forwardly arched front edge 19. In the region of the floor areas 8 and in the region of the gable areas 9 a fin seal 16 is formed after the closure. In FIG. 2F the ears 14 and the fin sea 16 are shown projecting. Both the ears 14 and also the fin seal 16 are applied in a later production step, for example by a bonding technique.

In FIG. 2G the carton 15' of FIG. 2F is illustrated with attached ears 14. The regions of the carton already described in connection with FIG. 1A to FIG. 2F are provided in FIG. 2G with corresponding reference numerals. In addition to the ears 14 also the fin seals 16 are attached to the carton 15'. The upper ears 14 arranged in the region of the gable area 9 are turned down and laid flat against the sleeve area 17. Preferably the upper ears 14 are bonded or welded to the sleeve area 17. The lower ears 14 arranged in the region of the floor area 8 are likewise turned down, but however are attached flat against the lower side of the carton 15', which is formed by two rectangular areas 12 of the floor area 8. Preferably also the lower ears 14 are bonded or welded to the carton 15', in particular to the rectangular areas 12. The carton 15' illustrated 1 FIG. 2G does not however have any fold edges in the region of the front sleeve area 17A. The front side of the carton forwardly arched according to the invention can be clearly recognised in the horizontal section illustrated on the right by the plane X of the carton. The straight carton edges 2' at the rear carton edges extend from the lower corner points E8 up to the upper corner points E9.

FIG. 2E' also illustrates the carton sleeve 10' of FIG. 2D with pre-folded floor and gable areas, and accordingly here too corresponding reference numerals are used. The difference compared to FIG. 2E is that the lower triangular areas 13 are not folded outwardly, but instead are folded inwardly.

FIG. 2F' also shows a first arrangement of a carton 15' according to the invention, which is formed from the carton sleeve 10' shown in FIG. 2B, after the sealing and in the filled and closed state. Here too corresponding reference numerals are therefore used. The difference with regard to FIG. 2F is that the triangular areas 13 were not folded outwardly, but instead inwardly, before the welding. Therefore the lower "ears" 14 do not project outwardly, but extend inwardly. This leads to a shorter fin seal 16.

In FIG. 2G' the carton 15' of FIG. 2F' is illustrated with attached upper ears 14 and attached upper fin seal 16. Here too corresponding reference numerals are therefore used. The lower fin seal 16 is folded down and attached to the lower side of the carton 15', which is formed by two rectangular areas 12B of the floor area 8. Preferably the fin seal 16 is bonded or welded to the carton 15', in particular to a rectangular area 12B. The difference with respect to FIG. 2G lies in the structure of the floor of the carton 15': in FIG. 2G the ears 14 are arranged underneath the rectangular areas 12B and are thus visible from the lower side; in FIG. 2G' on the other hand the rectangular areas 12 are arranged underneath the ears 14 and are thus visible from the lower side.

Figure 3A:
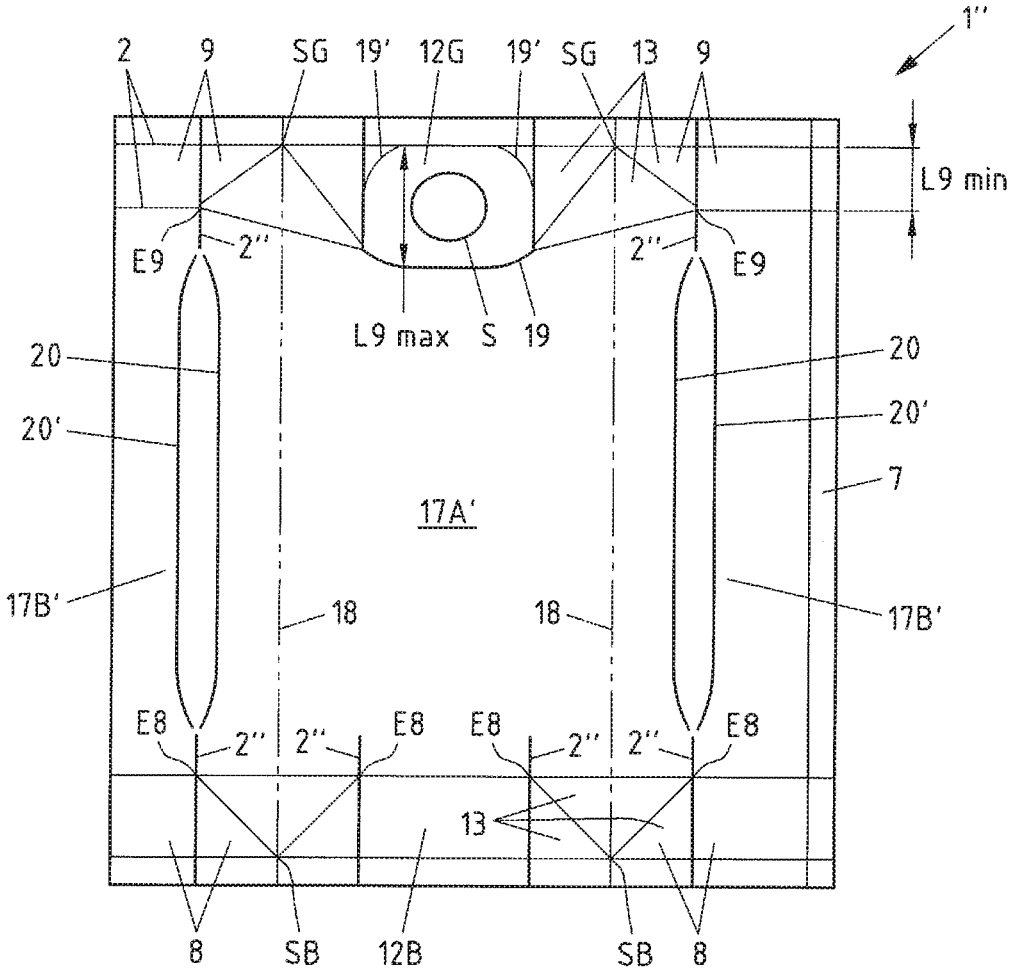
FIG. 3A: a blank for the production of a second embodiment of a carton sleeve according to the invention.

FIG. 3A shows a blank 1" for the production of a second arrangement of a carton sleeve according to the invention. The blank 1" in FIG. 3A corresponds in the front region to the blank 1' in FIG. 2A, so that here too corresponding reference numerals are used. Also, the blank 1" has in the region of the sleeve area 17 two pseudo fold lines 18. In addition the pseudo fold lines 18 pass through a point of contact SB of three adjacent triangular areas 13 of the floor area 8 and through a point of contact SG of three adjacent triangular areas 13 of the gable areas 9. The sleeve area 17' is subdivided into an inner partial region 17A' and into two outer partial regions 17B' by the pseudo fold lines 18. The inner partial region 17A' lies between both pseudo fold lines 18, and the outer partial region 17B' lie outside the two pseudo fold lines 18.

Instead of the continuous rear fold lines of the first exemplary embodiment, here there are no continuous fold lines on the sleeve area 17B', but only relatively short fold line stumps 2" adjacent to one another underneath the corner points E9 and also above the corner points E8, between which extend (after a small interruption) in each case two subdivided fold lines 20 and 20' running substantially parallel to one another, which closely approach one another above and below after a short bend shortly in front of the fold line stumps 2".

Also, underneath in the inner partial region 17A' of the sleeve area 17' relatively short fold line stumps 2" are present above the corner points E8, which ensure a particularly good seal of the floor in the case when the carton is produced on a mandrel, without significantly altering the overall impression of the carton.

Figure 3B:
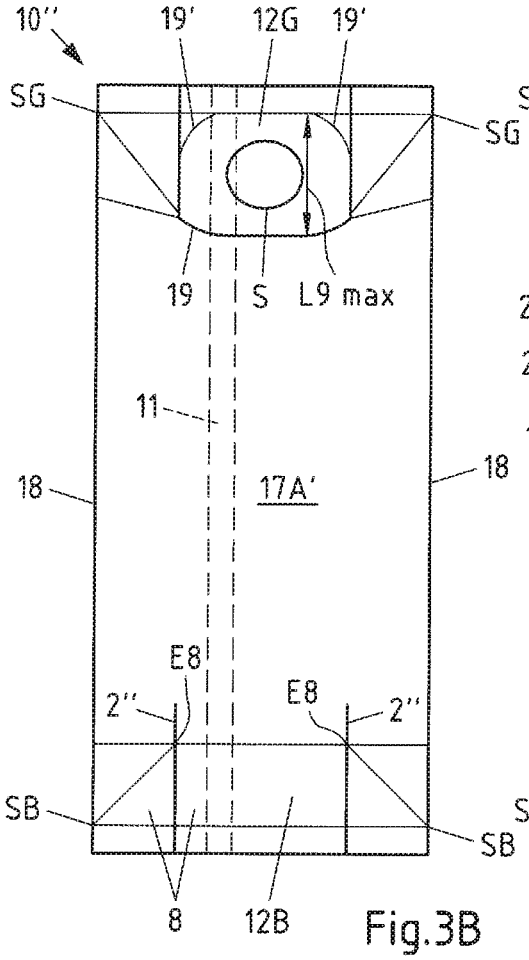
FIG. 3B: a carton sleeve that is formed from the blank shown in FIG. 3A, in a front view.

In FIG. 3B a second arrangement of a carton sleeve 10" according to the invention, which is formed from the blank 1" shown in FIG. 3A, is illustrated in a front view. The carton sleeve 10" in FIG. 3B corresponds largely to the carton sleeve 10' in FIG. 2B, so that here too corresponding reference numerals are used. The difference lies only in the previously described fold line stumps 2" in the lower front partial region 17A' of the sleeve area 17' above the corner points E8.

Figure 3C:
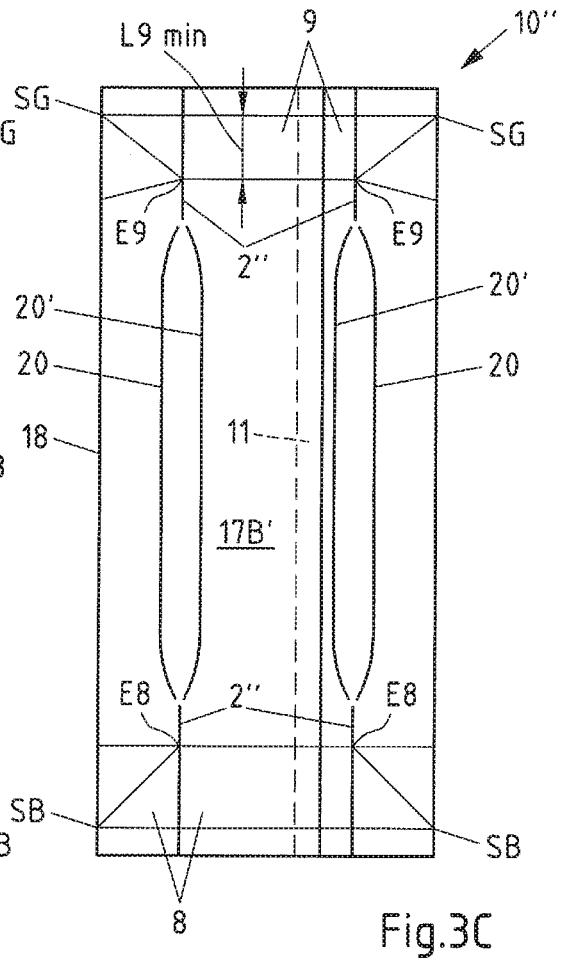
FIG. 3C: the carton sleeve of FIG. 3B in a rear view.

FIG. 3C shows the carton sleeve 10" of FIG. 3B in a rear view. The carton sleeve 10" in FIG. 3C largely corresponds to the carton sleeve 10' in FIG. 2C, so that here too corresponding reference numerals are used. The fold line stumps 2" adjoining one another underneath the corner points E9 and also above the corner points E8 and the subdivided fold lines 20 and 20' extending therebetween in the outer partial region 17B' of the sleeve area 17' again form a significant difference.

Figure 3D:
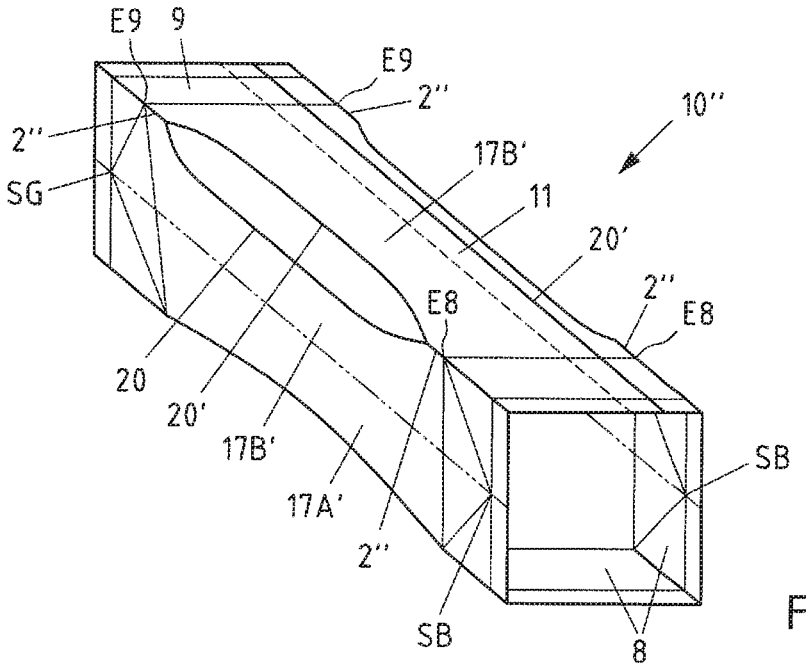
FIG. 3D: the carton sleeve from FIG. 3B and FIG. 3C in the unfolded state.

In FIG. 3D the carton sleeve 10" of FIG. 3B and FIG. 3C is illustrated in the unfolded state. The carton sleeve 10" in FIG. 3D corresponds largely to the carton sleeve 10' in FIG. 2D, so that here too corresponding reference numerals are used. Also, the differences on account of the completely different configuration of the rear side of the carton sleeve due to the subdivided fold lines 20 and 20' can however clearly be recognised.

FIG. 3E shows the carton sleeve 10' of FIG. 3D with pre-folded floor and gable areas. The carton sleeve 10" in FIG. 3E corresponds largely to the carton sleeve 10' in FIG. 2E, so that here too corresponding reference numerals are used. The "dissolution" of the rear carton edges is however clearly visible especially in the view from behind.

In FIG. 3F a second arrangement of a carton 15" according to the invention, which is formed from the carton sleeve 10" shown in FIG. 3B, is illustrated after the welding, but still with downwardly and upwardly laterally projecting ears 14. The carton 15" in FIG. 3F corresponds largely to the carton 15' in FIG. 2F, so that here too corresponding reference numerals are used. Here too the carton is provided on the gable area with a pouring element AE, which extends almost up to the forwardly arched front edge 19. The different configuration of the rear carton region can however hardly be recognised in the view from the front.

FIG. 3G finally shows the carton 15" of FIG. 3F with attached ears 14. The carton 15" in FIG. 3G corresponds largely to the carton 15' in FIG. 2G, so that here too corresponding reference numerals are used. In this case also the "constriction" at the rear "carton edges" due to the subdivided fold lines 20 and 20' is almost unrecognisable in the view from the front.

The FIGS. 3E', 3F' and 3G' as well as the section X show again the carton sleeve 10" of FIG. 3D with pre-folded floor and gable areas, wherein the ears 14 formed by the lower triangular areas 13 are folded not outwardly, but inwardly. Corresponding reference numerals are again therefore also used in this case. Again, in the section X the forwardly arched front wall of the carton is clearly recognisable. In addition to the fold lines 20 and 20' spanning an area bent by about 45° at the rear "carton edges", the ears folded inwardly into the interior of the carton can also clearly be recognised in the section X.

LIST OF REFERENCE NUMERALS

1, 1', 1": Blank
2, 2': Fold line
2": Fold line stump
3, 4: Side area
5: Front area
6: Rear area
7: Sealing area
8: Floor area
9: Gable area
10, 10', 10": Carton sleeve
11: Longitudinal seam
12B: Rectangular area
12G: Gable area
13: Triangular area
14: Ear
15, 15', 15": Carton
16: Fin seal
17, 17': Sleeve area
17A, 17A', 17B, 17B': Partial region (of the sleeve area 17)
18: Pseudo fold line
19, 19': Front edge, embossed line (of the front gable area 12)
20, 20': Fold lines
AE: Pouring element
E8: Corner point (of the floor area 8)
E9: Corner point (of the gable area 9)
S: Line of weakness
SB: Contact point (of the triangular areas 13 of the floor area 8)
SG: Contact point (of the triangular areas 13 of the gable area 9)

The invention claimed is:

1. A carton sleeve of a composite material for producing a carton, comprising:

a sleeve area comprising a front partial area and a rear partial area, a longitudinal seam, which joins two edges of the composite material to form an all-round carton sleeve and is arranged on the rear partial area, two pseudo fold lines, which pass through the sleeve area, and at least one floor area and at least one gable area, wherein the carton sleeve is folded along the two pseudo fold lines, and the at least one floor area and at least one gable area are arranged on opposite sides of the carton sleeve, each comprising two rectangular areas, and gable areas, and six triangular areas, and the carton sleeve in a region of the front partial area has no further fold lines between the two pseudo fold lines.

2. The carton sleeve according to claim 1, wherein the carton sleeve is folded flat along the two pseudo fold lines by an angle of about 180°.

3. The carton sleeve according to claim 1, wherein the pseudo fold lines pass through a point of contact of three adjacent triangular areas of the floor area and through a point of contact of three adjacent triangular areas of the gable area.

4. The carton sleeve according to claim 1, wherein the gable area on a rear side of the carton sleeve has a shorter length than the length of the gable area on a front side of the carton sleeve.

5. The carton sleeve according to claim 1, wherein the front side of the carton sleeve has a front gable area that is bounded with respect to the sleeve areas by a front edge that is convexly curved at least over some sections.

6. The carton sleeve according to claim 5, wherein the front gable area comprises upper edge regions with convexly curved embossed lines.

7. The carton sleeve according to claim 1, wherein the front gable area has a centrally arranged zone of weakness.

8. The carton sleeve according to claim 1, wherein the pseudo fold lines are scored on the outside of the carton sleeve.

9. The carton sleeve according to claim 1, wherein the fold lines are scored on the inside of the carton sleeve.

10. A carton of a composite material, wherein the carton is produced from a carton sleeve according to claim 1, closed in the regions of the floor areas and gable areas, and has no, or no continuous, fold edges in the region of the sleeve area.

11. The carton according to claim 10, wherein the fold lines are provided on the rear partial area, and are interrupted and/or subdivided at least over some sections.

12. The carton according to claim 10, wherein the partial regions of the sleeve area adjoining the pseudo fold lines are arranged in an angular range between 160° and 200° with respect to one another.

13. The carton according to claim 10, wherein at least one ear is attached in the lower region of the carton to the floor areas.

14. The carton according to claim 10, wherein at least one ear is attached in the upper region of the carton to the sleeve area.

15. A carton of a composite material, wherein the carton is produced from a carton sleeve according to claim 1, closed in the regions of the floor areas and the gable areas, and has no, or no continuous, fold edges in the region of the front sleeve area.

16. A method for producing a carton from a carton sleeve of a composite material, comprising:

providing a carton sleeve according to claim 1, and folding the sleeve area of the carton sleeve back along both pseudo fold lines.

17. The method according to claim 16, wherein the partial regions of the sleeve area adjoining the pseudo fold lines lie, after having been folded back again, in an angular range between 160° and 200° with respect to one another.

18. A carton sleeve of a composite material for producing a carton, comprising:

a sleeve area comprising a front partial area and a rear partial area, a longitudinal seam, which joins two edges of the composite material to form an all-round carton sleeve and is arranged on the rear partial area, two pseudo fold lines, which pass through the sleeve area, and at least one floor area and at least one gable area, wherein the carton sleeve is folded along the two pseudo fold lines, and the at least one floor area and at least one gable area are arranged on opposite sides of the carton sleeve, each comprising two rectangular areas, and gable areas, and six triangular areas, and the carton sleeve in a region of the front partial area has no continuous fold lines between the two pseudo fold lines, and the gable area on the rear side of the carton sleeve has a shorter length than the length of the gable area on the front side of the carton sleeve.

19. The carton sleeve according to claim 18, wherein fold lines are provided on the rear partial surface, and are interrupted and/or subdivided at least in some sections.

20. The carton sleeve according to claim 19, wherein the fold lines arranged on the rear partial surface are formed as at least one fold line stump, and are arranged in the at least one floor region and/or the at least one gable region of the carton sleeve.

21. The carton sleeve according to claim 19, wherein the fold lines arranged on the rear partial surface are formed as subdivided fold lines that run substantially parallel to one another.

22. A carton of a composite material, wherein the carton is produced from a carton sleeve according to claim 18, closed in the regions of the floor areas and gable areas, and has no, or no continuous, fold edges in the region of the sleeve area.

23. A carton of a composite material, wherein the carton is produced from a carton sleeve according to claim 18, closed in the regions of the floor areas and the gable areas, and has no, or no continuous, fold edges in the region of the front sleeve area.

* * * * *